US006886909B2

(12) United States Patent
Ogasawara

(10) Patent No.: US 6,886,909 B2
(45) Date of Patent: May 3, 2005

(54) INKJET IMAGE FORMING APPARATUS

(75) Inventor: Seiji Ogasawara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/435,478

(22) Filed: May 12, 2003

(65) Prior Publication Data

US 2003/0214549 A1 Nov. 20, 2003

(30) Foreign Application Priority Data

May 14, 2002 (JP) ..... 2002-138090

(51) Int. Cl.[7] ..... B41J 2/165
(52) U.S. Cl. ..... 347/35; 347/36
(58) Field of Search ..... 347/22, 31, 35, 347/36, 45

(56) References Cited

U.S. PATENT DOCUMENTS 5,291,227 A * 3/1994 Suzuki ..... 347/104
6,239,817 B1 * 5/2001 Meyer ..... 347/36
6,659,587 B1 * 12/2003 Berg et al. ..... 347/36

FOREIGN PATENT DOCUMENTS

JP 2000-118058 4/2000

* cited by examiner

*Primary Examiner*—Shih-Wen Hsieh
(74) *Attorney, Agent, or Firm*—Fitzpatrick, Cella, Harper & Scinto

(57) ABSTRACT

The present invention relates to an inkjet image forming apparatus capable of recording non-margin images on a recording medium by discharging ink from a recording head to regions within as well as beyond edges of the recording medium. The apparatus includes an ink absorbing material for receiving ink discharged at a position beyond the recording medium and a platen having a holding portion to hold the ink absorbing material and supporting the recording medium at a recording position. The holding section formed at the platen has an opening for receiving the ink and is formed with a wall for holding a periphery of the ink absorbing material and a rib supporting a bottom of the ink absorbing material.

16 Claims, 11 Drawing Sheets

INKJET IMAGE FORMING APPARATUS

BACKGROUND OF THE INVENTION

1. Field of the Invention

This invention relates to an ink jet image forming apparatus capable of recording with no margin at sheet edges by recording up to positions extending beyond the sheet edges.

2. Description of Related Art

Referring to FIG. 9 to FIG. 11, a recording apparatus of the prior art is described. An inkjet image forming apparatus has been conventionally known having a structure capable of non-margin recording by providing an opening on a conveyance surface of a platen 100 for holding the sheet at an image forming position, forming a recess 101 made of vertical surfaces and a bottom surface below the opening, and providing an ink absorbing material (hereinafter referred to as "platen ink absorbing material") 102 at the recess 101, and the specific structure thereof is disclosed in JP-A-2000-118,058.

With such an inkjet image forming apparatus, because the platen ink absorbing material 102 is held by vertical four side walls and the bottom surface, if ink droplets are discharged as to exceed a permissive ink amount of the platen ink absorbing material 102, the ink may flow out of the platen ink absorbing material 102 and over the sheet conveyance surface of the platen 100 and may stain the sheet.

To solve this problem, as shown in FIG. 11, a structure has been known in which the ink overflowing from the platen ink absorbing material 102 is prevented from flowing over the sheet conveyance surface of the platen 100 by arranging an ink absorbing material (hereinafter referred to as "connecting ink absorbing material") for transmitting to an ink absorbing material (hereinafter referred to as "ink absorbing material") for receiving ink discarded during an absorption recovery operation of the ink discharging nozzles in the recording head or a preliminary ink discharging operation.

With the above structure, however, the costs are inevitably increased because the connecting ink absorbing material is required at right and left ends of the respective sheet sizes to correspond to the different sheet sizes.

SUMMARY OF THE INVENTION

This invention is intended to solve the above problems raised in the prior art. It is an object of the invention to provide an inkjet image forming apparatus capable of recording with no margin at sheet edges to prevent ink from flowing out of a platen ink absorbing material and over a sheet conveyance surface of a platen with an inexpensive structure.

A representative structure according to the invention to accomplish the above object is an inkjet image forming apparatus capable of recording non-margin images on a recording medium by discharging ink to regions within as well as beyond edges of the recording medium from a recording means, including an ink absorbing material for receiving ink discharged at a position protruded from the recording medium, and a platen having a holding portion to hold the ink absorbing material and supporting the recording medium at a recording position, wherein the holding section formed at the platen has an opening for receiving the ink and is formed with a wall for holding a periphery of the ink absorbing material and a grid shaped rib supporting a bottom of the ink absorbing material.

As described above, according to the invention, an inkjet image forming apparatus for recording with no margin can prevent ink droplets discharged at a position beyond edges of a sheet from flowing over a recording medium conveyance surface of a platen with an inexpensive structure.

DETAILED DESCRIPTION OF THE PREFERRED EMBODIMENTS

[First Embodiment]

Hereinafter, an inkjet image forming apparatus according to an embodiment of the invention is described based on FIG. 1 to FIG. 6.

It is to be noted that the inkjet image forming apparatus of this embodiment is applicable to a photocopier, a facsimile machine, or the like, and is not limited to a printer.

[The Whole Structure]

First, an outlined structure of the entire apparatus and the operation of recording with no margin in which this invention's effect is advantageous will be described.

Figure 1:
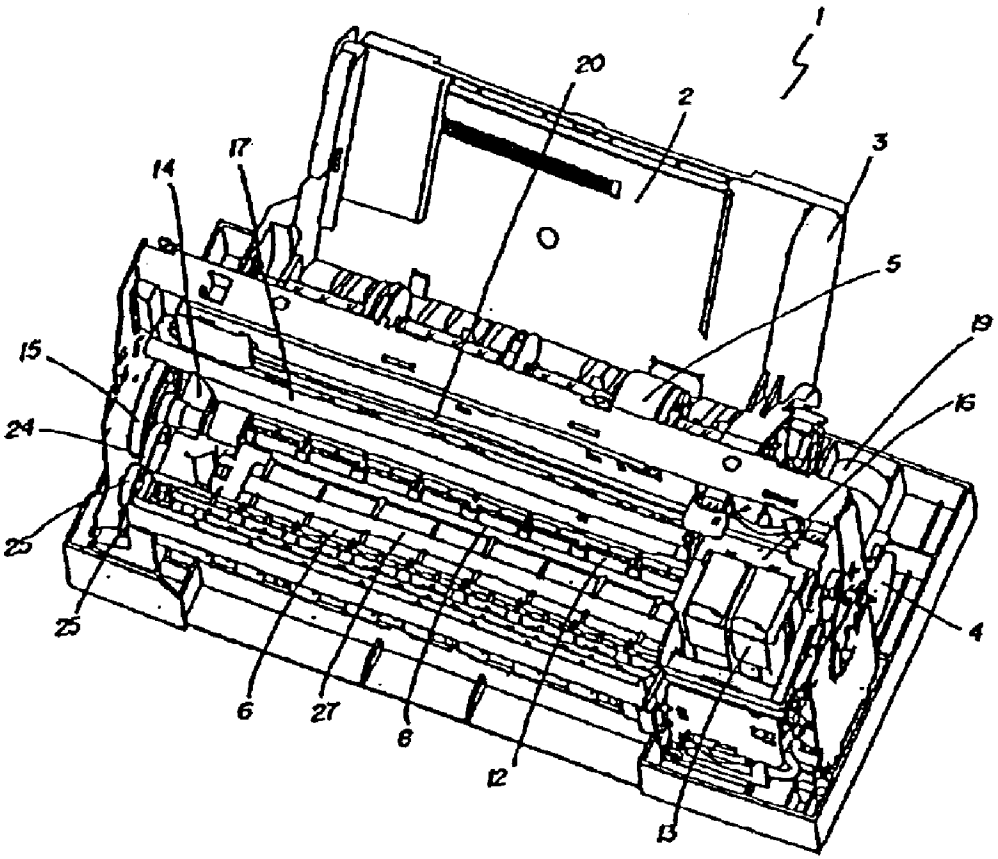
FIG. 1 is a perspective view of an inkjet image forming apparatus showing an embodiment of the invention.
Figure 2:
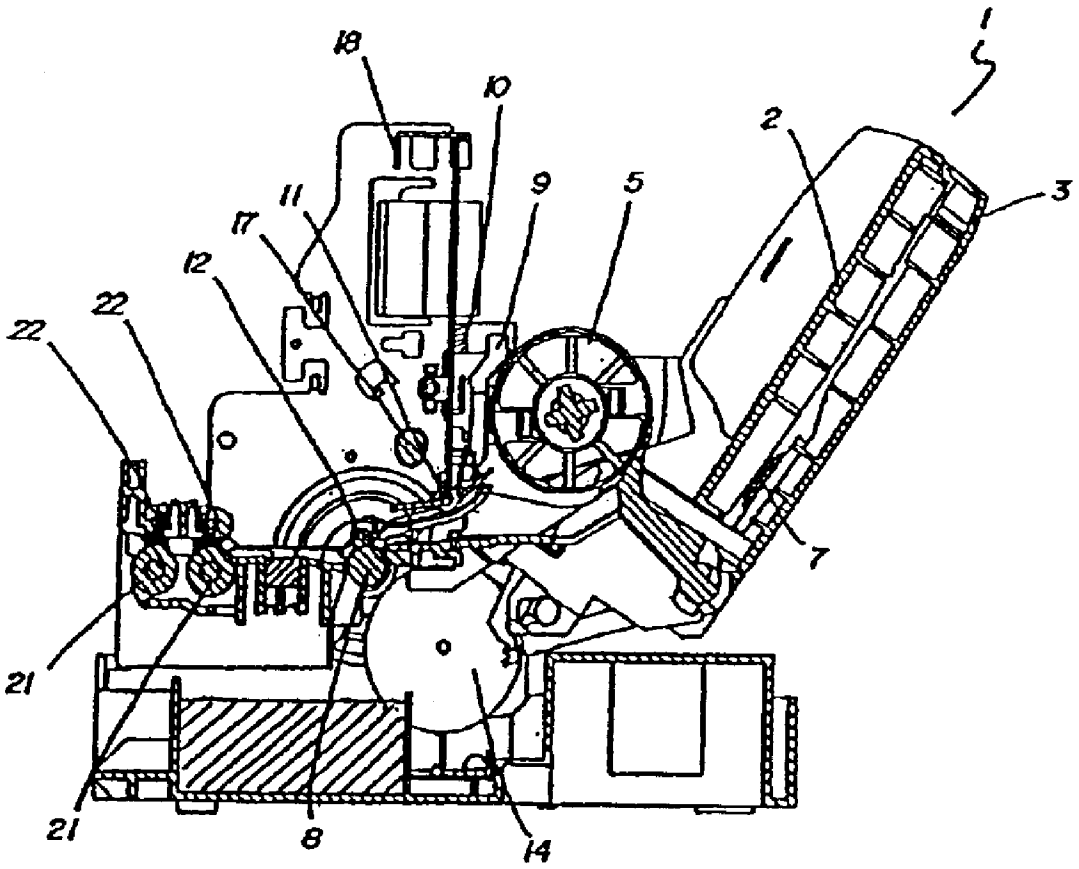
FIG. 2 is a side cross-section of the inkjet image forming apparatus showing the embodiment of the invention.

As shown in FIG. 1 and FIG. 2, a pressing plate 2 of a feeding apparatus 1 is supported pivotally to a feeding apparatus frame 3, and sheet bundles are stacked on a top face of the pressing plate 2. During sheet feeding, a feeding roller 5 rotates in association with a feeding motor 4 as a drive source, and the pressing plate 2 moves pivotally toward the feeding roller 5 with the aid of a pressing plate spring 7 to press the sheet bundle to the feeding roller 5. When the feeding roller 5 further rotates, only the topmost sheet of the sheet bundle is separated and fed in a downstream direction.

The sheet separated and fed by the feeding apparatus 1 is fed to a conveyance roller 8 according to further rotation of the feeding roller 5.

When the front end of the sheet separately fed from the feeding apparatus 1 pushes a sensor lever 9 disposed between the feeding roller 5 and the conveyance roller 8, the sensor lever 9 is pivotally moved, and when the sensor lever 9 moves beyond a sheet sensor 10, the front end of the sheet is detected. The rear end of the sheet is detected by entry of the sensor lever 9 to the sheet sensor 10.

The sheet is conveyed in a prescribed amount with a feeding roller 5 on the basis of the detected results of the front end of the sheet described above, and hits a nipping portion formed by contact between the conveyance roller 8 and a pinch roller 12 urged to the conveyance roller 8 by a pinch roller spring 11. The sheet is further conveyed in a prescribed amount by the feeding roller 5 to curve the front end of the sheet, thereby pushing the front end of the sheet to the nipping portion, and rendering the registration operation completed.

After the completion of the registration operation, the sheet is conveyed on a platen 6 by the conveyance roller 8, and is held on the top surface of the platen 6 at a position in opposition to a surface of ink discharging nozzles of a mounted recording head 13 serving as a recording means. The conveyance roller 8 is rotated via a conveyance roller gear 15 by a stepping motor 14 as a drive source.

Images are subsequently formed upon scanning a carriage 16 across the sheet supported on a sheet passing surface of the platen 6, while discharging ink droplets out of the recording head 13 mounted on the carriage 16. The carriage 16 is supported to be capable of scanning in a direction perpendicular to the sheet conveyance direction with a guide shaft 17 and a guide rail 18 and is driven via a timing belt 20 by a driving force from a carriage motor 19.

It is to be noted that this recording head 13 has plural fine orifices, a fluid passage, an energy operation section formed at a part of the fluid passage, and an energy generating means for generating energy to be applied to a fluid in the operation section for producing droplets.

As an energy generating means for generating such energy, exemplified are those utilizing a recording method using electro-mechanical converters such as piezo devices, a recording method using an energy generating means for discharging droplets by operation of generated heat upon heat generation from radiation of electromagnetic waves from a source such as a laser or the like, or a recording method using an energy generating means for discharging fluid upon heating the fluid with an electro-thermal converter such as a heating device having a heat generating resistor.

In view of the energy generating means described above, a recording head that uses the inkjet recording method in which fluid is discharged by thermal energy is able to make high resolution recording because the orifices for forming discharged droplets for recording can be arranged at a high density. A recording head using electro-thermal converters as energy generating means advantageously can be readily made compact, readily mounted at high density, and made with reduced manufacturing costs.

In this embodiment, as an ink discharging structure, recording is effected by energizing the electro-thermal converter in accordance with a recording signal and by growing and contracting bubbles in the ink by utilizing film boiling occurring in the ink due to the thermal energy to discharge the ink out of the orifices. Discharging the ink upon growing and contracting bubbles with thermal energy accomplishes discharging of the fluid with excellent response.

Figure 3:
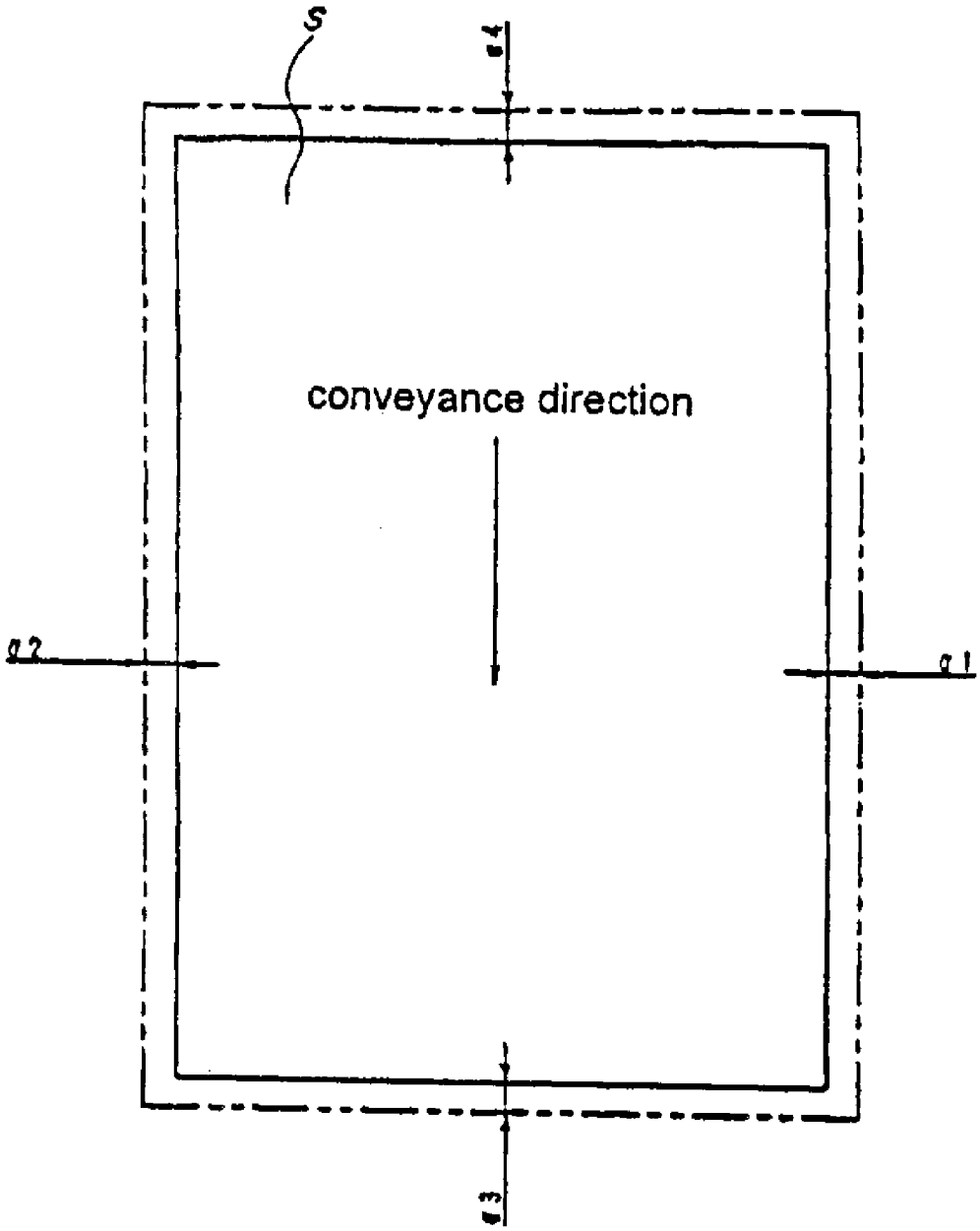
FIG. 3 is a schematic view showing an image forming range during non-margin recording with respect to the embodiment of the invention.

When recording with no margin is to be effected on a sheet, such recording with no margin can be realized by causing recording to extend by prescribed amounts a1 to a4 in a manner shown with a double dotted chain line from four sheet edges with respect to a sheet S as an actual recording medium shown with a solid line in FIG. 3. The prescribed amounts a1 to a4 are set in consideration of sheet conveyance accuracy and sheet cutting accuracy and, in fact, a distance of 2 to 3 mm is proper.

Finally, the sheet on which the image formation is completed is delivered to the exterior of the apparatus by a delivery roller 21 and a driven spur 22 pressed to the delivery roller 21 with a spur spring (not shown). The delivery roller 21 is rotated via the conveyance roller gear 15, an intermittent gear 24, and a delivery roller gear 25 by the stepping motor 14 as a drive source.

[Platen Ink Absorbing Structure]

In the non-margin recording, ink is discharged beyond the sheet region as described above. A platen ink absorbing body 27 for absorbing the ink discharged outside the sheet region is arranged at a holding portion of the platen 6. Next, a bottom structure of an opening (holding portion) of the platen 6 for holding the platen ink absorbing material 27 will be described.

Figure 4:
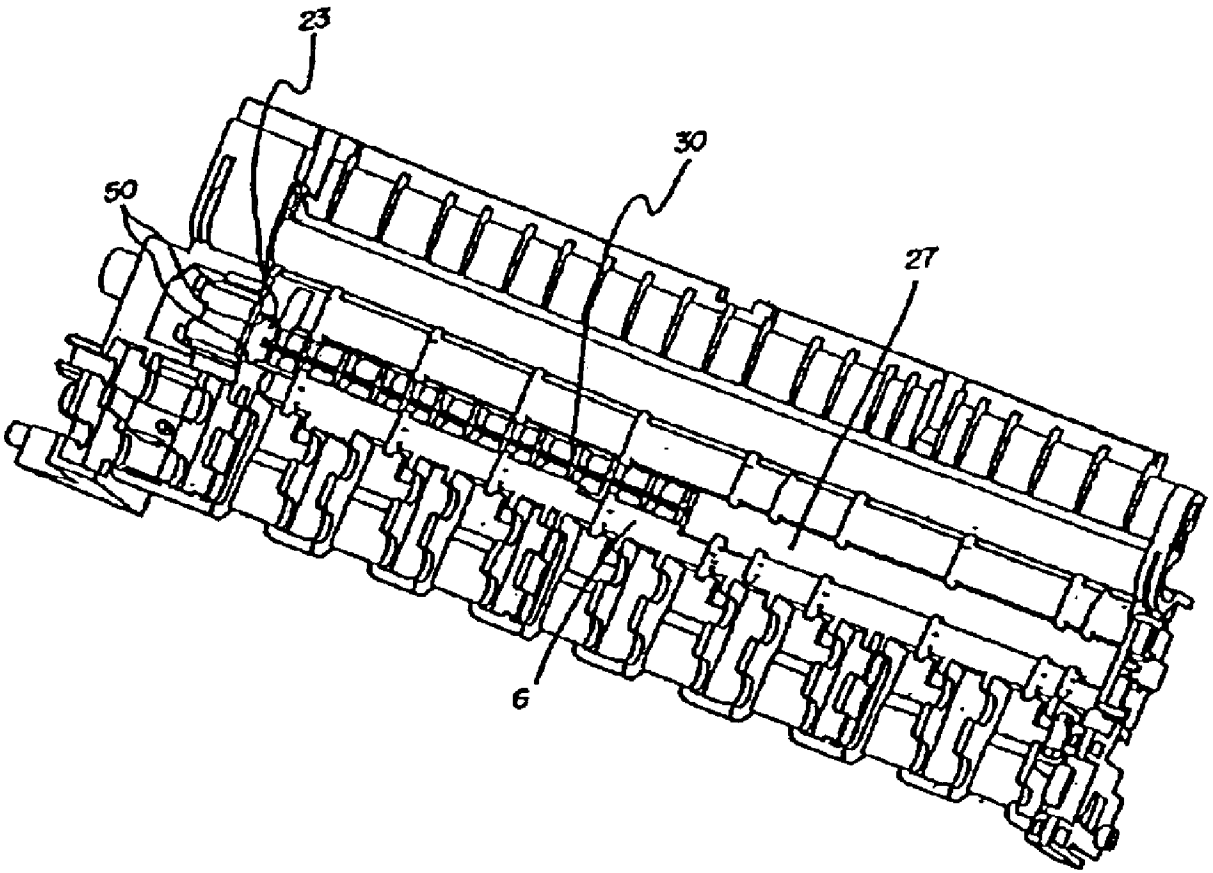
FIG. 4 is a perspective view showing a portion relating to the non-margin recording in the first embodiment of the invention.
Figure 5:
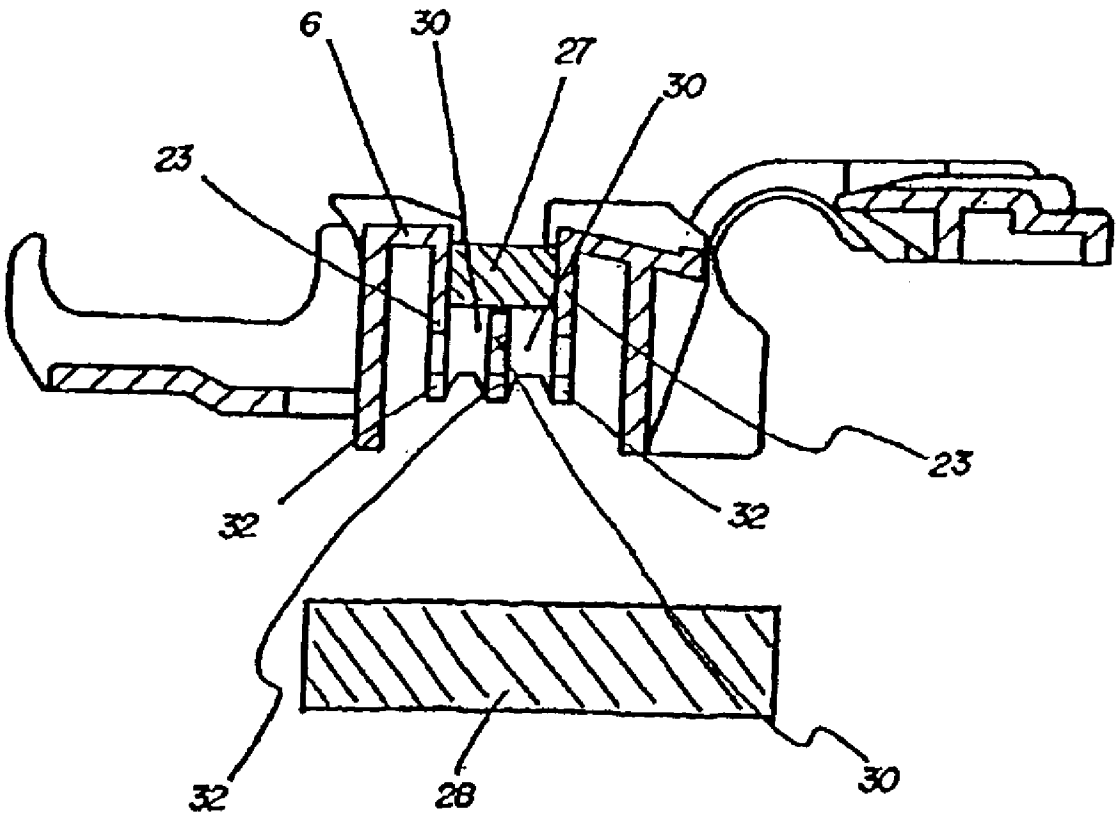
FIG. 5 is a side cross-section showing the portion relating to the non-margin recording in the first embodiment of the invention.
Figure 6:
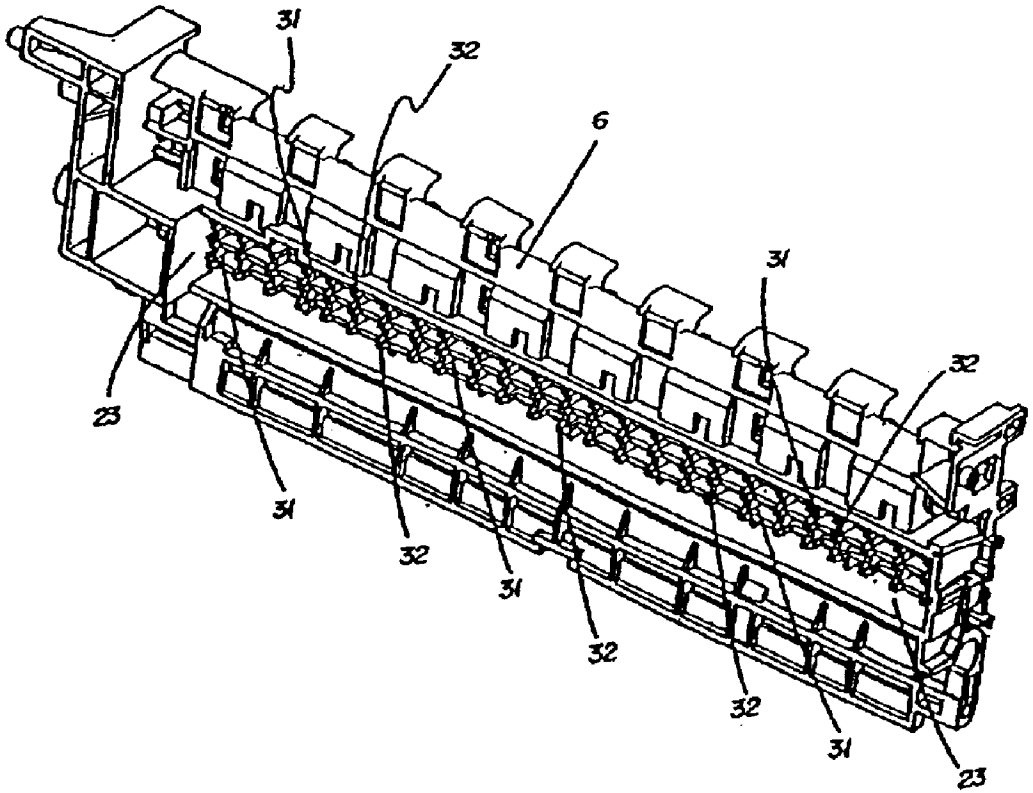
FIG. 6 is a perspective view of the portion relating to the non-margin recording in the first embodiment of the invention when viewed from below.

As shown in FIG. 4 to FIG. 6, the platen ink absorbing material 27 is held on a wall surface 23 extending substantially vertically downward from the opening formed on a sheet passing surface of the platen 6 as well as on a top surface of a grid shaped rib 30 that extends substantially vertically downward and connects to the wall face 23 midway of the wall face 23.

With execution of the recording with no margin, ink droplets discharged at positions beyond the sheet arrive at a surface of the platen ink absorbing material 27. The ink arriving at the platen ink absorbing material 27 gradually moves downwardly in the platen ink absorbing material 27 by its weight. The material of the platen ink absorbing material 27 may be a highly foamed urethane of a low density or the like to improve the ink absorbing property.

The ink remaining at a lower portion of the platen ink absorbing material 27 moves downward through plural corners 31 formed as angled portions of the grid shaped rib 30 from the top surface of the grid shaped rib 30 in contact with a bottom surface of the platen ink absorbing material 27 by operation of forces due to surface tension. The ink reaching the bottom of the grid shaped rib 30 becomes droplets, which drip and are absorbed in an apparatus ink absorbing material 28 formed further below.

Formation of protrusions 32 at the intersections of the lower surface of the grid shaped rib 30 structurally promotes ink reaching the lower surface of the grid shaped rib 30 via the corners 31 to accumulate and drip.

It is desirable to form corners 50 reaching the sheet conveyance surface of the platen 6 in a curved shape to prevent the ink from transmitting due to effects of the surface tension force, like the corners 31 formed by the wall extending vertically downward from the opening formed on the sheet conveyance surface of the platen 6.

A surface of the wall 23 extending vertically downward from the opening formed on the sheet conveyance surface of the platen 6 is desirably formed to have a lesser water repellence property at portions in a direction toward a lower portion from a vertically upper portion by adjustment of the surface roughness. This causes an effect of rendering ink contacting the wall surface 23 to flow to the lower portion due to a relation of the water repellence property.

In the embodiment as described above, with the inkjet image forming apparatus capable of non-margin recording, the bottom surface of the opening of the platen 6 holding the ink absorbing material 27 for receiving the ink droplets discharged at positions extending beyond the sheet is structured with the grid shaped rib 30, and therefore, the ink overflowing from the ink absorbing material 27 is transmitted from the corners 31 of the grid shaped rib 30, thereby reaching the apparatus waste ink absorbing material disposed below the platen for receiving ink discarded by the absorption recovery operation of the printer head and ink droplets preliminarily discharged.

In this operation, without use of any member such as an absorbing material for transmitting ink from the ink absorbing material 27 disposed at the platen opening to the apparatus ink absorbing material 28, this apparatus can prevent ink from flowing out of the ink absorbing material disposed at the platen opening and over the sheet conveyance surface of the platen with an inexpensive structure.

[Second Embodiment]

Figure 7:
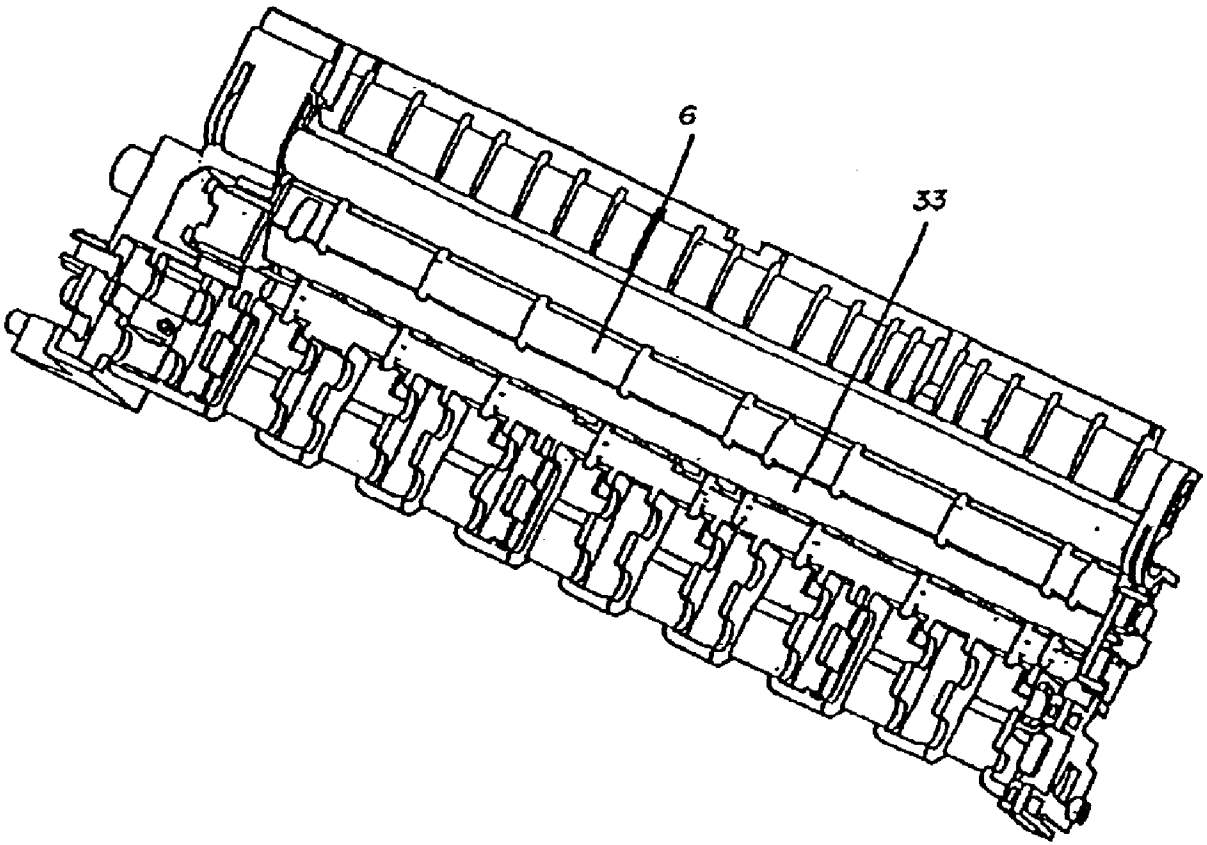
FIG. 7 is a perspective view showing a portion relating to the non-margin recording in the second embodiment of the invention.
Figure 8:
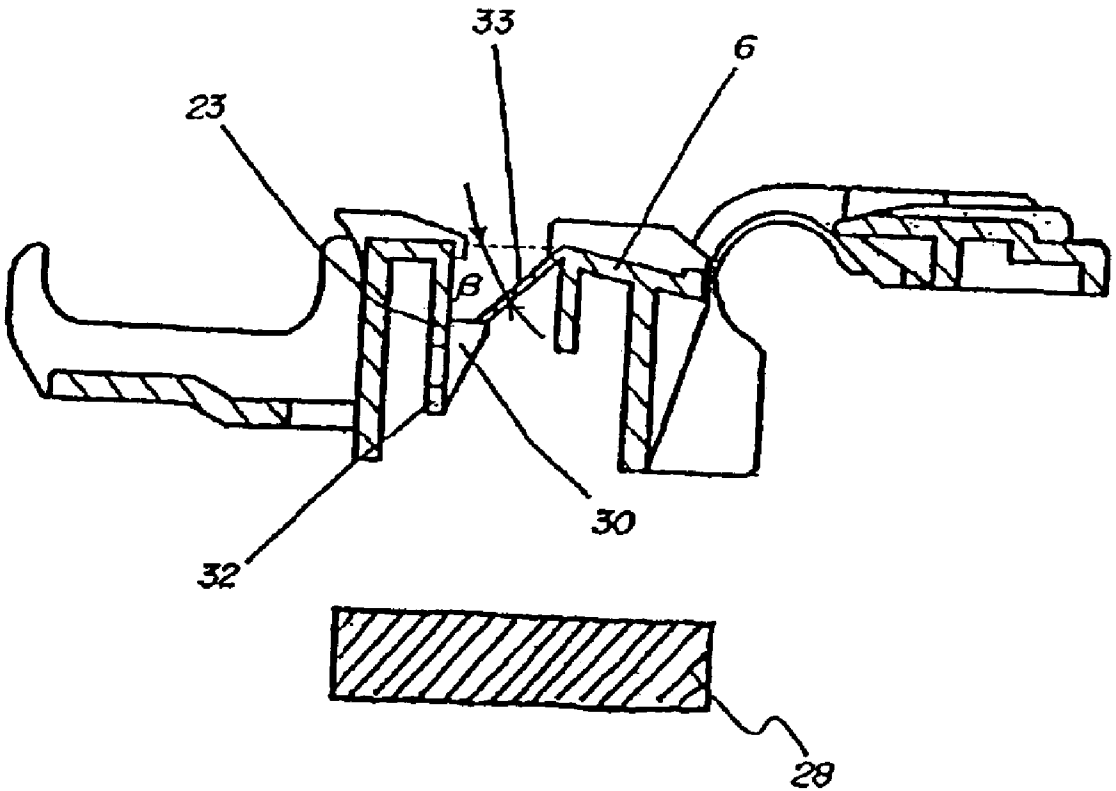
FIG. 8 is a side cross-section showing the portion relating to the non-margin recording in the second embodiment of the invention.
Figure 9:
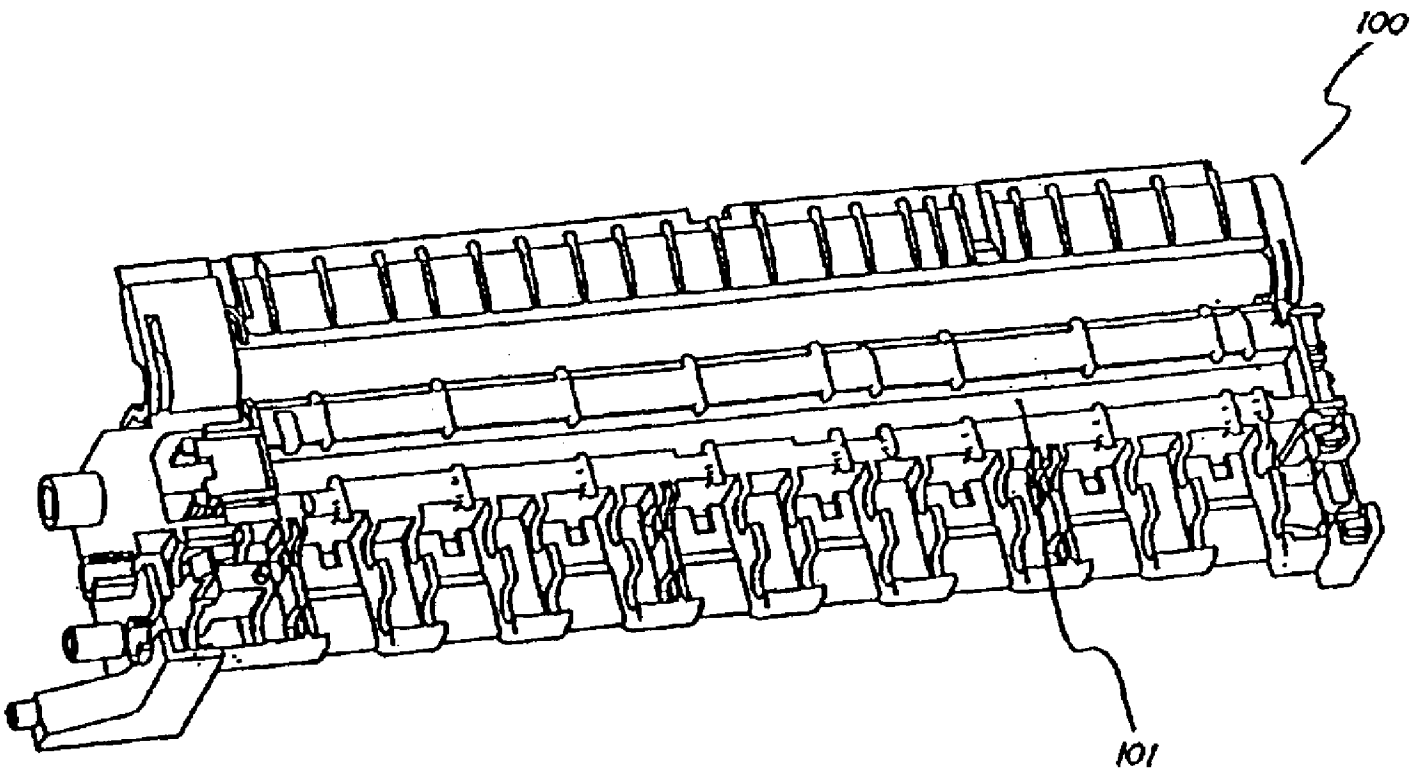
FIG. 9 is a perspective view showing a portion relating to the non-margin recording in an ink jet image forming apparatus of the prior art.
Figure 10:
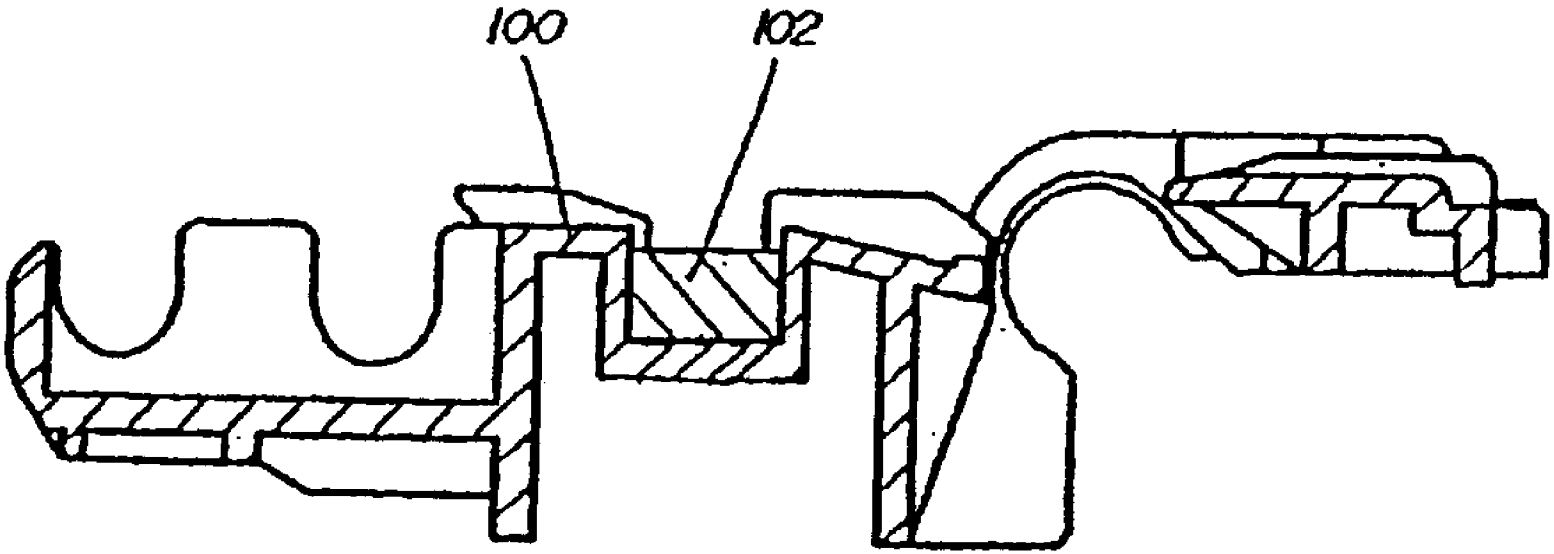
FIG. 10 is a side cross-section showing a portion relating to the non-margin recording in an inkjet image forming apparatus of the prior art.
Figure 11:
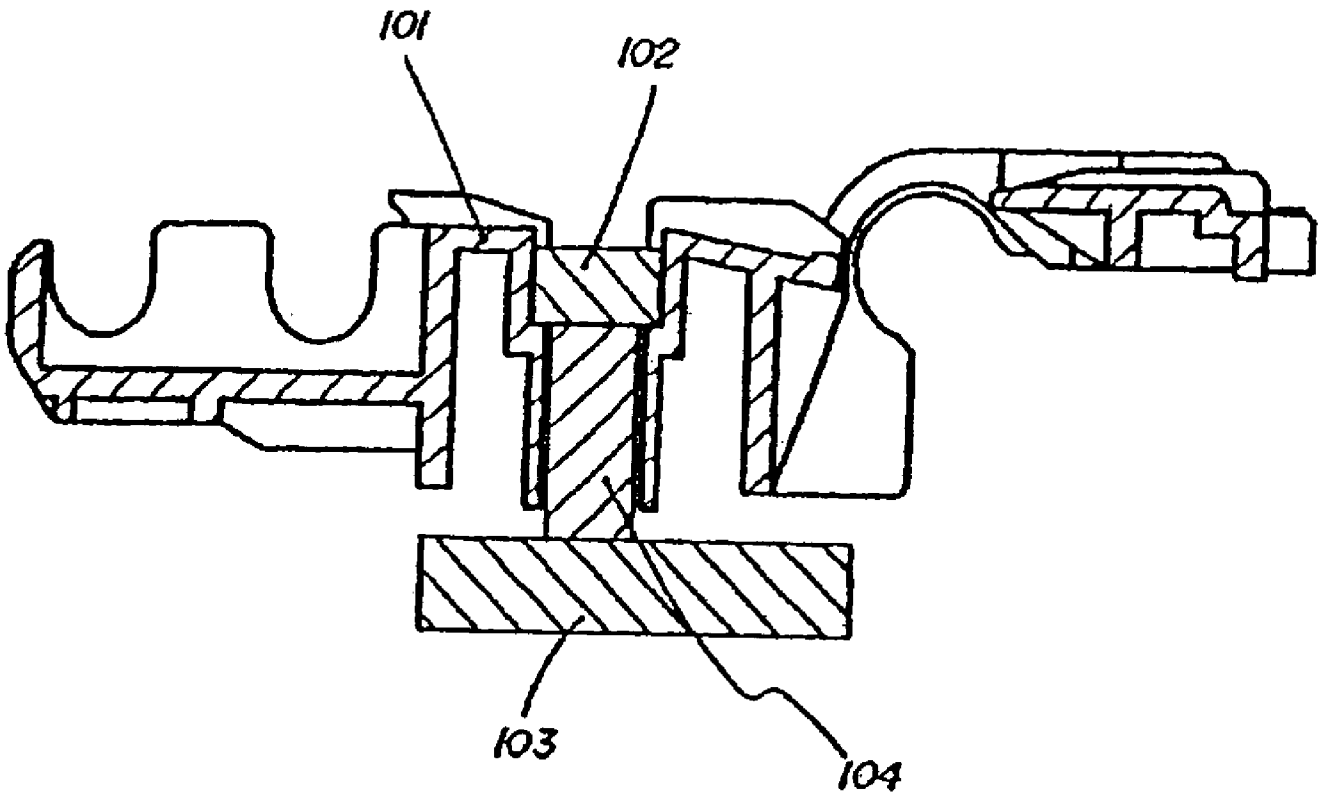
FIG. 11 is a side cross-section showing a portion relating to the non-margin recording in an ink jet image forming apparatus of the prior art.

Referring to FIG. 7 and FIG. 8, another embodiment of a platen ink absorbing structure will be described. It is to be noted that the basic structure of the apparatus is substantially the same as that in the above-described embodiment, and the same reference numerals are assigned to members having the same function.

As shown in FIG. 7 and FIG. 8, in a platen ink absorbing structure according to this embodiment, a wall surface 23 extending vertically downward from the opening formed on the sheet conveyance surface of the platen 6 and a bottom surface secured to an outer periphery of the wall surface 23 are formed. An ink droplet discharging range by the recording head located at the bottom is of a slope 33 formed to be inclined in the sheet conveyance direction. The slope 33 is inclined obliquely downward toward the wall surface on one side from a top end on the other side of the wall surface 23 in the sheet conveyance direction, but the lower end does not completely extend to the wall surface on the one side, so the opening is formed. The grid shaped rib 30 is formed to extend downward from the lower end of the slope 33 at the opening (the bottom surface except the slope 33).

With this structure, when recording with no margin is to be effected, the ink droplets discharged at the positions protruded from the sheet arrive on the slope 33.

The ink that has arrived at the slope 33 flows downward on the slope 33 due to gravity. A part of the ink droplets that arrive at the slope 33 is considered to be rebounded to the slope 33. To prevent the rebounded ink droplets from landing on the sheet conveyance surface of the platen 6, it is necessary to set angle β between the slope 33 and the horizontal plane to be 45 degrees or more. It is to be noted that formation of a groove or grooves along the inclined direction of the slope 33 may be effective to promote the ink arrived on the slope 33 to flow downward on the slope 33.

The ink flowing downward on the slope 33 moves to a lower portion via the plural corners 31 formed at the grid shaped rib 30 by effect of the surface tension force from the top surface of the grid shaped rib 30 extending downward from the lower end of the slope 33. The ink reaching the bottom of the grid shaped rib 30 drips and is absorbed by the apparatus ink absorbing material 28 formed at a further lower portion.

In substantially the same way as in the first embodiment described above, formation of protrusions 32 at the intersections of the lower surface of the grid shaped rib 30 promotes ink reaching the lower surface of the grid shaped rib 30 via the corners 31 to accumulate and drip. It is desirable to form the corners reaching the sheet conveyance surface of the platen 6 in a curved shape to prevent the ink from transmitting due to effects of the surface tension force, like the corners formed by the wall 23 extending vertically downward from the opening formed on the sheet conveyance surface of the platen 6, or corners formed by the wall 23 and the slope 33.

It is also effective to promote the ink moving downward by reducing the water repellence property in portions in a direction approaching the lower portion from the upper portion by adjustment of the surface roughness of the surfaces of the wall 23 extending substantially vertically downward and the slope 33 from the opening formed on the sheet conveyance surface of the platen 6.

As described above, in this embodiment, the costs thereof can be reduced because not only the connecting ink absorbing material, but also the platen ink absorbing material, are unnecessary.

[Third Embodiment]

In the second embodiment described above, a portion of the grid shaped rib forming the bottom of the opening formed on the sheet conveyance surface of the platen 6 may be formed in a through-hole shape, and walls extending substantially vertically downward may be formed at the periphery of the through-hole. With such a structure, ink flowing downward on the slope 33 falls in the apparatus waste ink absorbing material 28 arranged below by moving along the walls extending substantially vertically.

As described, in this embodiment, substantially the same advantages as that in the second embodiment can be obtained with the simpler platen structure.

Although in the respective embodiments described above the serial type image forming apparatus is described in which the recording head 13 is mounted on the carriage 16 and moved reciprocally to effect inkjet recording, the ink absorbing structures in the above embodiments are applicable to a line type inkjet image forming apparatus performing image recording by discharging the ink on a basis of a line by conveying the sheet past ink discharging orifices arranged in a width greater than the sheet width.

What is claimed is:

1. An inkjet image forming apparatus capable of recording non-margin images on a recording medium by discharging ink from recording means to regions within as well as beyond edges of the recording medium, comprising:

an ink absorbing material for receiving ink discharged at a position beyond the recording medium;

a platen for supporting the recording medium, said platen having a holding portion to hold said ink absorbing material, wherein said holding portion is formed with a wall for holding a periphery of said ink absorbing material, and wherein said platen has a first opening through which the ink is received by said ink absorbing material, and a second opening open to a bottom surface of said ink absorbing material; and a rib being in contact with the bottom surface of said ink absorbing material, so that the ink disposed at a lower portion of said ink absorbing material moves downward along said rib and drips from said rib.

2. The inkjet image forming apparatus according to claim 1, wherein the wall is vertical, and wherein said rib is a grid shaped rib extending downward from a position supporting said ink absorbing material.

3. The inkjet image forming apparatus according to claim 1, wherein a corner of the wall positioned on the recording means side with respect to said ink absorbing material is in a curved shape.

4. An inkjet image forming apparatus capable of recording non-margin images on a recording medium by discharging ink from recording means to regions within as well as beyond edges of the recording medium, comprising:

a platen having a holding portion to hold the ink absorbing material, wherein an opening is formed in a wall at a position corresponding to the recording means at said platen and a slope is formed at least at a part of the opening and inclined with respect to a conveyance direction of the recording medium, and wherein the opening, except at a position of the slope, has a grid shaped rib extending downward from a lower edge of the slope.

5. The inkjet image forming apparatus according to claim 4, wherein the slope is secured to a vertical wall at an outer periphery thereof.

6. The inkjet image forming apparatus according to claim 4, wherein the slope is inclined with an angle of 45 degrees or more with respect to the conveyance direction of the recording medium.

7. The inkjet image forming apparatus according to claim 4, wherein the slope includes at least one groove disposed in an inclined direction.

8. The inkjet image forming apparatus according to claim 1 or claim 4, wherein water repellence property of the wall decreases from an upper portion to a lower portion.

9. The inkjet image forming apparatus according to claim 1 or claim 4, wherein the rib has a protrusion at an intersection on a lower surface thereof.

10. The inkjet image forming apparatus according to any one of claims 1–6 or 7, wherein the recording means comprises an electro-thermal converter that is energized according to a signal and discharges ink by utilizing film boiling occurring in the ink due to thermal energy generated by the electro-thermal converter.

11. An inkjet image forming apparatus capable of recording non-margin images on a recording medium by discharging ink from recording means to regions within as well as beyond edges of the recording medium, comprising:

an ink absorbing material for receiving ink discharged at a position beyond the recording medium;

a platen for supporting the recording medium, said platen having a holding portion for holding said ink absorbing material, wherein said platen has a first opening through which the ink is received by said ink absorbing material and a second opening open to a bottom surface of said ink absorbing material; and a rib being in contact with the bottom surface of said ink absorbing material, so that the ink disposed at a lower portion of said ink absorbing material moves downward along said rib and drips from said rib.

12. An inkjet image forming apparatus according to claim 11, further comprising a second ink absorbing material for receiving ink dripped from said rib.

13. An inkjet image forming apparatus according to claim 11, wherein a protrusion is formed at a bottom of said rib so that the ink disposed at the lower portion of said ink absorbing material moves downward along said rib and drips from said protrusion.

14. An inkjet image forming apparatus capable of recording non-margin images on a recording medium by discharging ink from recording means to regions within as well as beyond edges of the recording medium, comprising:

a platen for supporting the recording medium, wherein said platen has a slope inclined with respect to a conveyance direction of the recording medium and an opening adjacent to a lower end of the slope, and wherein ink droplets discharged from the recording means arrive on the slope and flow to the opening.

15. An inkjet image forming apparatus according to claim 14, wherein the ink droplets discharged from the recording means drop into the opening.

16. An inkjet image forming apparatus according to claim 14, further comprising a rib formed extending downwardly from the lower end of the slope.

* * * * *

UNITED STATES PATENT AND TRADEMARK OFFICE

CERTIFICATE OF CORRECTION

PATENT NO. : 6,886,909 B2
DATED : May 3, 2005
INVENTOR(S) : Seiji Ogasawara

It is certified that error appears in the above-identified patent and that said Letters Patent is hereby corrected as shown below:

Column 5,
Lines 41 and 42, should continue the same paragraph.

Column 7,
Line 28, “claims 1-6 or 7” should read -- claims 1-7 --.

Signed and Sealed this

Seventeenth Day of January, 2006

JON W. DUDAS
*Director of the United States Patent and Trademark Office*